US012467120B2

(12) United States Patent
Kim et al.

(10) Patent No.: US 12,467,120 B2
(45) **Date of Patent: *Nov. 11, 2025**

(54) ENAMEL STEEL SHEET AND MANUFACTURING METHOD THEREFOR

(71) Applicant: POSCO, Pohang-si (KR)

(72) Inventors: Jai-Ik Kim, Pohang-si (KR); Hyun-Seok Ko, Pohang-si (KR)

(73) Assignee: POSCO, Pohang-si (KR)

( * ) Notice: Subject to any disclaimer, the term of this patent is extended or adjusted under 35 U.S.C. 154(b) by 657 days.

This patent is subject to a terminal disclaimer.

(21) Appl. No.: 17/786,276

(22) PCT Filed: Dec. 17, 2020

(86) PCT No.: PCT/KR2020/018612

§ 371 (c)(1),
(2) Date: Jul. 21, 2022

(87) PCT Pub. No.: WO2021/125858

PCT Pub. Date: Jun. 24, 2021

(65) Prior Publication Data

US 2023/0029838 A1 Feb. 2, 2023

(30) Foreign Application Priority Data

Dec. 20, 2019 (KR) ..... 10-2019-0172458

(51) Int. Cl.
*C22C 38/04* (2006.01)
*B21B 1/24* (2006.01)
(Continued)

(52) U.S. Cl.
CPC ..... *C22C 38/04* (2013.01); *B21B 1/24* (2013.01); *C21D 8/0226* (2013.01); *C22C 38/02* (2013.01); *C22C 38/06* (2013.01)

(58) Field of Classification Search
CPC ..... B21B 1/24; C21D 8/02; C21D 8/0226; C22C 38/00; C22C 38/02; C22C 38/04; C22C 38/06; C22C 38/14; C22C 38/16
See application file for complete search history.

(56) References Cited

U.S. PATENT DOCUMENTS

2010/0040872 A1* 2/2010 Murakami ..... C22C 38/04 148/648
2010/0086431 A1* 4/2010 Murakami ..... C21D 8/0273 420/91

(Continued)

FOREIGN PATENT DOCUMENTS

CN 101356295 A 1/2009
CN 101517115 A 8/2009

(Continued)

OTHER PUBLICATIONS

English machine translation of WO-2008038474-A1 of Hidekuni (Year: 2008).*

(Continued)

*Primary Examiner* — Keith D. Hendricks
*Assistant Examiner* — Mayela Aldaz
(74) *Attorney, Agent, or Firm* — Morgan Lewis & Bockius LLP

(57) ABSTRACT

Described herein is an enamel steel sheet comprising by wt %, 0.01 to 0.05% of C, 0.46 to 0.80% of Mn, 0.001 to 0.03% of Si, 0.01 to 0.08% of Al, 0.001 to 0.02% of P, 0.001 to 0.02% of S, 0.004% or less (excluding 0%) of N, 0.003% or less (excluding 0%) of O, and the balance of Fe and inevitable impurities. The enamel steel sheet may include an oxide layer from the surface to the inner direction thereof, wherein the oxide layer has a thickness of 0.006 to 0.003 μm.

14 Claims, 2 Drawing Sheets

(51) Int. Cl.

| | |
|---|---|
| ***C21D 8/02*** | (2006.01) |
| ***C22C 38/02*** | (2006.01) |
| ***C22C 38/06*** | (2006.01) |

(56) References Cited

U.S. PATENT DOCUMENTS

| | | | | |
|---|---|---|---|---|
| 2014/0227555 | A1* | 8/2014 | Kawata | C23C 2/12 148/287 |
| 2024/0011115 | A1* | 1/2024 | Kim | C21D 9/46 |

FOREIGN PATENT DOCUMENTS

| | | | | |
|---|---|---|---|---|
| CN | 103476955 | A | | 12/2013 |
| CN | 104561832 | A | | 4/2015 |
| CN | 104775069 | A | * | 7/2015 |
| CN | 105088065 | A | | 11/2015 |
| CN | 115135793 | B | | 11/2023 |
| GB | 1004155 | A | | 9/1965 |
| JP | 46-002740 | A | | 10/1971 |
| JP | S59-25008 | B2 | | 6/1984 |
| JP | H06-116634 | A | | 4/1994 |
| JP | H06-192727 | A | | 7/1994 |
| JP | H0660421 | B2 | * | 8/1994 |
| JP | H06-279864 | A | | 10/1994 |
| JP | H06-322445 | A | | 11/1994 |
| JP | H07-41864 | A | | 2/1995 |
| JP | H07-166296 | A | | 6/1995 |
| JP | 2000-273577 | A | | 10/2000 |
| JP | 2011-530658 | A | | 12/2011 |
| KR | 2009-0043570 | A | | 5/2009 |
| KR | 2014-0014248 | A | | 2/2014 |
| KR | 2015-0074891 | A | | 7/2015 |
| KR | 10-1657787 | B1 | | 9/2016 |
| KR | 10-2043795 | B1 | | 11/2019 |
| WO | 2008/035528 | A1 | | 3/2008 |
| WO | WO-2008038474 | A1 | * | 4/2008 ..... B22D 11/001 |
| WO | WO-2014015823 | A1 | * | 1/2014 ..... C21D 8/0205 |

OTHER PUBLICATIONS

English machine translation of WO-2014015823-A1 of Ju (Year: 2014).*

Office Action issued Aug. 29, 2023 for corresponding Japanese Patent Application No. 2022-538249.

International Search Report dated Jun. 3, 2021 issued in International Patent Application No. PCT/KR2020/018612 (with English translation).

* cited by examiner

ENAMEL STEEL SHEET AND MANUFACTURING METHOD THEREFOR

CROSS-REFERENCE OF RELATED APPLICATIONS

This application is the U.S. National Phase under 35 U.S.C. § 371 of International Patent Application No. PCT/KR2020/018612, filed on Dec. 17, 2020, which in turn claims the benefit of Korean Application No. 10-2019-0172458, filed on Dec. 20, 2019, the entire disclosures of which applications are incorporated by reference herein.

TECHNICAL FIELD

An exemplary embodiment of the present invention relates to an enamel steel sheet and a manufacturing method therefor. More specifically, an exemplary embodiment of the present invention relates to a continuous annealing type enamel steel sheet for processing that does not cause bubble defects after enamel treatment and has excellent enamel adhesion and fishscale resistance, and a manufacturing method therefor.

BACKGROUND ART

An enamel steel sheet is a type of surface treatment product that improves corrosion resistance, weather resistance, heat resistance, etc. by applying a glassy glaze on a base steel sheet such as a hot-rolled steel sheet or a cold-rolled steel sheet and then firing the base steel sheet at a high temperature. This enamel steel sheet is used as materials for exterior construction, home appliances, tableware, and various industries.

Rimmed steel has been used as an enamel steel sheet for a long time. However, as continuous casting has been actively used in terms of productivity improvement, most materials are being continuously cast. In addition, a fishscale defect, which is one of the most fatal defects of the enamel steel sheet in steel manufacturing, is a typical enamel defect that is caused by dropping out an enamel layer in the form of fishscales as hydrogen dissolved in the steel during the manufacture of enamel products exists supersaturated in the steel while the enamel steel sheet is fired and cooled, and then is released to a surface of the steel. When such a fishscale defect occurs, rust occurs intensively in the defective site, which greatly reduces the value of the enamel products. Therefore, it is necessary to suppress the occurrence of the fishscale. In order to prevent the fishscale defect, it is necessary to form a large number of sites in the steel that may hold hydrogen dissolved in the steel. In order to prevent the fishscale defect that lowers enamel properties or to improve aging properties, an open coil annealing (OCA) method, which is a type of normal annealing method, has been sometimes applied. In this case, however, there is a problem in that the productivity is lowered by heat treatment for a long time, the manufacturing cost increases, and the quality deviation increases. In addition, the open coil annealing method has a problem in that it is difficult to control the amount of decarburization, and when the amount of carbon in the steel is too small because the amount of decarburization is too large, the grain boundaries of the steel sheet are softened, and thus, cracks such as brittle fracture occur during the molding of products. In order to overcome the problem of inferior productivity and increase in manufacturing cost caused by such annealing for a long time, the recently developed enamel steel sheet is actively using the continuous annealing process. In this case, as a hydrogen occlusion source, precipitates such as titanium, inclusions using undeoxidized steel, or the like have been used. However, even in this case, there is a problem in that the occurrence rate of surface defects increases due to the addition of a large amount of carbonitride-forming elements or non-deoxidized compounds, and the recrystallization temperature rises to reduce passing ability, lower productivity, and increase costs.

In other words, in the enamel steel sheet using titanium (Ti)-based precipitates, as a large amount of titanium is added to suppress the hydrogen reaction that causes the fishscale, nozzle clogging by titanium nitride (TiN) and inclusions occurs frequently during the continuous casting of the steelmaking process, which is a direct factor in the deterioration in workability and the production load. In addition, as TiN mixed in molten steel is present on the top of the steel sheet, a blister defect, which is a typical bubble defect, occurs, and titanium added in a large amount is a factor that inhibits adhesion between a steel plate and a glaze layer.

On the other hand, a high oxygen enamel steel sheet, which secures the fishscale resistance by occluding hydrogen using inclusions such as oxides in the steel by increasing the dissolved oxygen content inside the steel sheet, also has a fundamentally high oxygen content to make a dissolution loss of refractories severe, which greatly reduces the casting productivity in the steelmaking process, and causes a fundamental problem of frequent surface defects.

DISCLOSURE

Technical Problem

The present invention has been made in an effort to provide an enamel steel sheet and a manufacturing method therefor. More specifically, the present invention has been made in an effort to provide a continuous annealing type enamel steel sheet for processing that does not cause bubble defects after enamel treatment and has excellent enamel adhesion and fishscale resistance, and a manufacturing method therefor.

Technical Solution

An exemplary embodiment of the present invention provides an enamel steel sheet, including: by wt %, 0.01 to 0.05% of C, 0.46 to 0.80% of Mn, 0.001 to 0.03% of Si, 0.01 to 0.08% of Al, 0.001 to 0.02% of P, 0.001 to 0.02% of S, 0.004% or less (excluding 0%) of N, 0.003% or less (excluding 0%) of O, and the balance of Fe and inevitable impurities.

The enamel steel sheet according to one embodiment of the present invention includes an oxide layer from the surface to the inner direction thereof, wherein the oxide layer has a thickness of 0.006 to 0.003 μm.

The oxide layer may contain 90 wt % or more of Fe oxide

Adhesion relationship index (IPE') calculated by the following Equation 1 may be 0.001 to 0.020.

$$I_{PEI}=([Mn]\times[P]\times[Si]\times[\text{oxide layer thickness}])/([Al]\times[C]) \quad \text{[Equation 1]}$$

(In Equation 1, [Mn], [P], [Si], [Al], and [C] represent values obtained by dividing a content (wt %) of each element by an atomic weight of each element, and [oxide layer thickness] is the oxide layer represents a thickness (nm) of oxide layer)

A micropore area ratio difference (MVv) for each site calculated by the following Equation 3 may be 0.07 to 0.16%.

$$MVv=MV_{1/8t}-MV_{Av} \quad \text{[Equation 3]}$$

(In Equation 3, $MV_{1/8t}$ and $MV_{Av}$ represent a ⅛ site and an average micropore fraction in a thickness direction, respectively.)

The enamel steel sheet may further contain at least one of 0.01 wt % or less of Cu and 0.005 wt % or less of Ti.

A cementite fraction difference (Cv) calculated by the following Equation 2 may be 0.8 to 2.5%.

$$CV=C_{1/2t}-C_{1/8t} \quad \text{[Equation 2]}$$

(In Equation 2, $C_{1/2t}$ and $C_{1/8t}$ represent the cementite fraction in a center and a ⅛ site in the thickness direction of the steel sheet, respectively.)

Enamel adhesion may be 95% or more.

A hydrogen permeation ratio may be 600 sec/mm$^2$ or more.

Another embodiment of the present invention provides a method of manufacturing an enamel steel sheet, including: manufacturing a hot-rolled steel sheet by hot rolling a slab containing, by wt %, 0.01 to 0.05% of C, 0.46 to 0.80% of Mn, 0.001 to 0.03% of Si, 0.01 to 0.08% of Al, 0.001 to 0.02% of P, 0.001 to 0.02% of S, 0.004% or less (excluding 0%) of N, 0.003% or less (excluding 0%) of O, and the balance of Fe and inevitable impurities, and the balance of Fe and inevitable impurities; manufacturing a cold-rolled steel sheet by cold rolling the hot-rolled steel sheet; and annealing the cold-rolled steel sheet.

In the annealing, heat treatment may be performed for 30 seconds to 180 seconds in a wet atmosphere having an oxidation capacity index ($PH_2O/PH_2$) of 0.51 to 0.65.

The slab may be hot-rolled at a finish rolling temperature of 850° C. to 910° C.

in the manufacturing of the hot-rolled steel sheet, the hot-rolled steel sheet may be wound at 580° C. to 720° C.

In the manufacturing of the cold-rolled steel sheet, the cold rolling may be performed at a reduction ratio of 60 to 90%.

In the annealing of the cold-rolled steel sheet, the annealing may be performed at 720° C. to 850° C.

The method may further include after the annealing of the cold-rolled steel sheet, temper rolling at a reduction ratio of 3% or less.

Advantageous Effects

According to an embodiment of the present invention, the enamel steel sheet having excellent fishscale resistance and enamel adhesion can be used for home appliances, chemical equipment, kitchen equipment, sanitary equipment, interior and exterior materials of buildings, and the like.

According to an embodiment of the present invention, in an enamel steel sheet having excellent fishscale resistance and enamel adhesion, by suppressing a chemical composition of steel within an appropriate range and controlling an adhesion relationship index, it is possible to allow a manufactured cold-rolled steel sheet to secure high enamel adhesion. In addition, by controlling the fraction of carbides and micropores in the surface layer and the center to suppress the fishscale and bubble defects, which are fatal defects of an enamel steel sheet, it is possible to remarkably improve the enamel properties.

According to an embodiment of the present invention, in an enamel steel sheet with excellent fishscale resistance and enamel adhesion, it is possible to improve productivity and operability by using low-carbon steel in the range of C: 0.02 to 0.08 wt % with excellent surface properties during steelmaking, and when a thin plate that is subjected to cold rolling is heat treated in a continuous annealing furnace, by optimizing furnace atmosphere and controlling a carbide fraction in steel in a thickness direction, it is possible to significantly improve enamel properties even during a high-speed heat treatment operation.

According to an embodiment of the present invention, in an enamel steel sheet having excellent fishscale resistance and enamel adhesion, it is possible to promote a decarburization reaction through atmosphere control in a continuous annealing process using cementite which is a low-temperature precipitate. Cementite is uniformly dispersed during hot rolling, and micropores formed by cold rolling and decarburization reaction act as a hydrogen occlusion source to prevent a fishscale defect caused by hydrogen. Meanwhile, according to an embodiment of the present invention, since residual carbon in the surface layer of the steel sheet acts as a factor of causing bubble defects in an enamel product due to a gasification reaction during enamel firing, by controlling a distribution of carbides and micropores in a thickness direction of a cold-rolled steel sheet, it is possible to prevent the occurrence of surface bubble defects as well as enamel properties.

MODE FOR INVENTION

Figure 1:
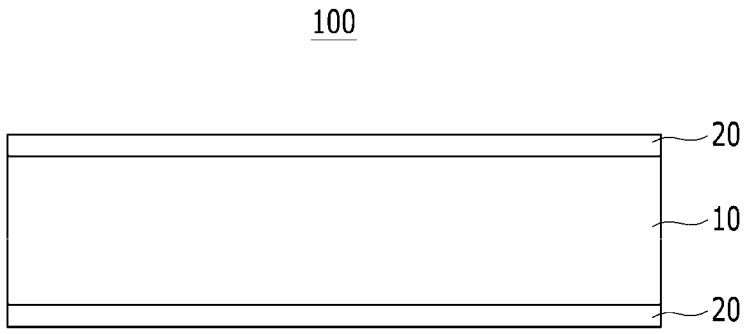
FIG. 1 is a schematic diagram of a cross section of an enamel steel sheet according to an exemplary embodiment of the present invention.

In the present specification, the terms first, second, third, and the like are used to describe, but are not limited to, various parts, components, areas, layers and/or sections. These terms are used only to distinguish a part, component, region, layer, or section from other parts, components, regions, layers, or sections. Accordingly, a first part, a component, an area, a layer, or a section described below may be referred to as a second part, a component, a region, a layer, or a section without departing from the scope of the present disclosure.

In the present specification, unless explicitly described to the contrary, when a part "includes" a certain component, it means that other components may be further included rather than excluding other components.

In the present specification, terminologies used herein are to mention only a specific exemplary embodiment, and do not to limit the present invention. Singular forms used herein include plural forms as long as phrases do not clearly indicate an opposite meaning. The meaning "including" used in the present specification concretely indicates specific properties, areas, integer numbers, steps, operations, elements, and/or components, and is not to exclude presence or addition of other specific properties, areas, integer numbers, steps, operations, elements, and/or components thereof.

In the present specification, the term "combination of these" included in the expression of the Markush format means one or more mixtures or combinations selected from the group consisting of the components described in the expression of the Markush format, and means including one or more selected from the group consisting of the components.

In the present specification, when a part is referred to as being "above" or "on" other parts, it may be directly above or on other parts, or other parts may be included in between. In contrast, when a part is referred to as being "directly above" another part, no other part is involved in between.

All terms including technical terms and scientific terms used herein have the same meaning as the meaning generally understood by those skilled in the art to which the present invention pertains unless defined otherwise. All terms including technical terms and scientific terms used herein have the same meaning as the meaning generally understood by those skilled in the art to which the present invention pertains unless defined otherwise.

In addition, unless otherwise specified, % means wt %, and 1 ppm is 0.0001 wt %.

In an embodiment of the present invention, further including additional elements means that the balance of iron (Fe) is replaced and included as much as the additional amount of the additional elements.

Hereinafter, an exemplary embodiment of the present invention will be described in detail so that a person of ordinary skill in the art to which the present invention pertains can easily implement the present invention. As those skilled in the art would realize, the described embodiments may be modified in various different ways, all without departing from the spirit or scope of the present invention.

An enamel steel sheet according to one embodiment of the present invention includes, by wt %, 0.01 to 0.05% of C, 0.46 to 0.80% of Mn, 0.001 to 0.03% of Si, 0.01 to 0.08% of Al, 0.001 to 0.02% of P, 0.001 to 0.02% of S, 0.004% or less (excluding 0%) of N, 0.003% or less (excluding 0%) of O, and the balance of Fe and inevitable impurities.

First, the reason for limiting the components of the steel plate will be described.

C: 0.01 to 0.05 wt %

When carbon (C) is added too much, the amount of dissolved carbon in steel increases, which increases strength, interferes with texture development during annealing, deteriorates formability, and causes bubble defects due to enamel layer bubbling. On the other hand, when C is too small, a fraction of carbides acting as sites where hydrogen is occluded in a cavity decreases, so there is a problem that it is vulnerable to a fishscale defect.

Carbon in a slab may be contained in an amount of 0.02 to 0.08 wt %. More specifically, the carbon in the slab may be contained in an amount of 0.024 to 0.076 wt %.

With respect to the manufacturing process to be described later, since decarburization is performed in a high oxidation capacity index atmosphere during a final annealing process, the C content in the slab and the C content in the final steel sheet may be different from each other. Since the decarburization is about 0.01 to 0.05 wt %, the C content in the final steel sheet may be 0.01 to 0.05 wt %. The C content in the final steel sheet may have a concentration gradient in the thickness direction, and the above-described C content represents an average of the C content in the entire steel sheet 100 including an oxide layer 20. More specifically, the C content in the final steel sheet may be 0.015 to 0.045 wt %.

Mn: 0.46 to 0.80 wt %

Manganese (Mn) is a representative solid solution strengthening element, and precipitates sulfur dissolved in steel in the form of manganese sulfide (MnS) to prevent hot shortness and promote carbide precipitation. When Mn is added too little, it is difficult to sufficiently obtain the above-described effect. On the other hand, when the content of Mn is too large, formability is deteriorated and Ara transformation temperature is lowered, which may cause a problem in that transformation occurs during enamel firing and deformation occurs. Accordingly, Mn may be contained in an amount of 0.46 to 0.80 wt %. More specifically, Mn may be contained in an amount of 0.48 to 0.78 wt %.

Si: 0.001 to 0.03 wt %

Silicon (Si) is an element that promotes the formation of carbides acting as a hydrogen occlusion source. When Si is added too little, it is difficult to sufficiently obtain the above-described effect. On the other hand, when Si is added too much, an oxide film is formed on the surface of the steel sheet, which may cause a problem of lowering enamel adhesion. Accordingly, Si may be emitted in an amount of 0.001 to 0.030 wt %. More specifically, Si may be contained in an amount of 0.002 to 0.027 wt %.

Al: 0.01 to 0.08 wt %

Aluminum (Al) is used as a powerful deoxidizer to remove oxygen in molten steel during steelmaking, and is an element that improves aging by adhering dissolved nitrogen. When Al is added too little, it is difficult to sufficiently obtain the above-described effect. On the other hand, when Al is added too much, aluminum oxide may remain in the steel or on the surface of the steel, thereby causing the problem of causing bubble defects such as blisters in the enamel treatment process. Accordingly, Al may be contained in the range of 0.01 to 0.08 wt %. More specifically, Al may be contained in the range of 0.014 to 0.077 wt %.

P: 0.001 to 0.020 wt %

Phosphorus (P) is a typical material strengthening element. When P is added too little, it is difficult to sufficiently obtain the above-described effect. On the other hand, when P is added too much, it not only deteriorates the formability by forming a segregation layer inside the steel sheet, but also deteriorates pickling property of the steel, which may adversely affect the enamel adhesion. Accordingly, P may be contained in the range of 0.001 to 0.020 wt %. More specifically, P may be contained in an amount of 0.002 to 0.018 wt %.

S: 0.001 to 0.020 wt %

Sulfur (S) is an element that binds to manganese to cause red hot brittleness. If S is added too little, a problem of worsening weldability may occur. When S is added too much, ductility is greatly reduced, which not only deteriorates workability, but also excessively precipitates manganese sulfide, which may adversely affect the fishscale properties of the product. Accordingly, S may be contained in the range of 0.001 to 0.020 wt %. More specifically, S may be contained in an amount of 0.002 to 0.018 wt %.

N: 0.004 wt % or less

Nitrogen (N) is a typical hardening element, but when the amount added increases, the problem of causing the aging defects frequently, lowering the formability, and causing the bubble defects in the enamel treatment process may occur. Therefore, the upper limit of N is limited to 0.004 wt %. More specifically, N may be contained in an amount of 0.0005 to 0.0037 wt %.

O: 0.003 wt % or less

Oxygen (O) is an essential element in forming oxides, and such oxides act as a factor that not only causes a dissolution loss of refractories during the steelmaking, but also causes surface defects due to oxides on the surface during steel sheet manufacturing. Therefore, the amount of 0 added in the slab may be 0.003 wt % or less. More specifically, the slab may contain 0.0001 to 0.0019 wt % of O.

With respect to the manufacturing process to be described later, in the final annealing process, decarburization is made in a high oxidation capacity index atmosphere to allow some oxygen to permeate, thereby forming the oxide layer 20. However, since the thickness of the oxide layer 20 is very thin compared to the entire steel sheet 100, there is substantially no change in the amount of oxygen in the entire steel sheet 100. 5 wt % or more of oxygen is contained in the oxide layer 20. More specifically, 10 to 50 wt % of O may be contained in the oxide layer 20. The oxygen content in the oxide layer 20 means an average content of oxygen in the oxide layer 20.

In addition to the above components, the present invention contains Fe and inevitable impurities. In addition to the above components, addition of effective components is not excluded. Examples of the inevitable impurities may contain Cu, Ti, etc. In an exemplary embodiment of the present invention, Cu and Ti are not intentionally added, and Cu may be contained in an amount of 0.01 wt % or less, and Ti may be contained in an amount of 0.005 wt % or less.

Next, the reason for limiting the volume fraction of carbides in the steel sheet micropores and hot rolling step of the present invention will be described.

The carbide used in the steel of the present invention is used as a hydrogen occlusion source that not only crushes the carbide itself in the cold rolling process due to the difference in ductility with the base material, or forms micropores by subsequent decarburization heat treatment, but also fixes hydrogen in the steel itself. Therefore, such a carbide fraction affects the enamel properties not only by itself but also by the interrelationship with the additive element. The steel sheet for enamel proposed in the present invention actively utilizes not only carbides such as Fe3C (cementite) but also micropores due to decarburization as a location of hydrogen occlusion by controlling the steel composition, and the present invention provides an enamel steel sheet and its products with excellent enamel adhesion and fishscale resistance without surface defects by controlling components and processes that affect enamel adhesion and surface defects among steel components. The cementite uniformly dispersed and precipitated during the hot rolling is crushed during the cold rolling, and also acts as a decarburization reaction source through atmosphere control during the annealing to form micropores that are hydrogen occlusion sources, which may effectively fix hydrogen in the steel to suppress the fishscale defect. By controlling the carbide and micropore fraction in the thickness direction by continuous annealing decarburization, and also controlling the oxide behavior of the steel sheet surface layer, it had a great effect in suppressing the enamel adhesion and bubble defects. On the other hand, unlike the high-temperature precipitation/inclusion system that is precipitated in the high-temperature solidification process, in an embodiment of the present invention, stable carbide is used at low temperature, thereby preventing the deterioration in workability such as the dissolution loss of the refractories or the clogging of the casting nozzle and the surface defects such as blackline, which were the problem in the existing enamel steel. The carbide fraction has a close relationship with the total carbon content in the steel and is also greatly affected by the operating conditions. On the other hand, in the case of the steel of the present invention, elements such as titanium (Ti), which have a higher oxidation property than iron (Fe), are not added, and the enamel adhesion between the steel sheet and the glaze may be greatly improved by controlling the surface oxide layer.

FIG. 1 illustrates a schematic diagram of a cross section of an enamel steel sheet according to an embodiment of the present invention. As illustrated in FIG. 1, the oxide layer 20 is contained in an inside direction from the surface of the steel sheet. The oxide layer 20 is distinguished from the steel sheet substrate 10 containing less than 5 wt % of oxygen (O) in that the oxide layer 20 contains 5 wt % or more of oxygen (O). Specifically, for the cross section of the steel sheet, when analyzing the oxygen concentration from the surface to the inside direction, the oxide layer 20 and the substrate 10 are divided based on a point containing 5 wt % of oxygen. When there are a plurality of points containing 5 wt % of oxygen, the innermost point is divided as a starting point.

The oxide layer 20 may include 90 wt % or more of Fe oxide Since the enamel products are products with organic glaze on the steel plate, it is very important to secure the adhesion between the steel plate and the glaze. In general, the main component of the glaze is made of silicon oxides ($SiO_2$), and in order to prevent the deterioration in the adhesion with the steel plate, an expensive glaze containing a large amount of NiO among the glaze components is often applied.

In an exemplary embodiment of the present invention, a method for improving the enamel adhesion by controlling the thickness of the oxide layer on the surface of the steel sheet was confirmed through repeated experiments. The enamel adhesion was improved by promoting covalent bonding with silicon (Si) atoms in the glaze layer by controlling the thickness of the oxide layer mainly composed of FeO in a certain range. To this end, it is necessary to manage the oxide layer thickness to 0.006 to 0.030 μm. When the thickness of the oxide layer is too thin, the bonding strength between the glaze layer and the steel sheet is low, making it difficult to secure enamel adhesion. On the other hand, when the thickness of the oxide layer is too thick, it is advantageous in terms of the adhesion, but there is a problem in that the surface properties of the steel sheet are deteriorated. Therefore, the thickness of the oxide layer 20 on the surface of the steel sheet was limited to 0.006 to 0.030 μm. More specifically, the oxide layer 20 may have a thickness of 0.007 to 0.028 μm. The thickness of the oxide layer 20 may be different throughout the steel sheet 100, and in one embodiment of the present invention, the thickness of the oxide layer 20 means an average thickness of the entire steel sheet 100.

Specifically, the adhesion relationship index ($I_{PEI}$) calculated by the following Equation 1 may be 0.001 to 0.020.

$$I_{PEI}=([Mn]\times[P]\times[Si]\times[\text{oxide layer thickness}])/([Al]\times[C]) \quad \text{[Equation 1]}$$

(In Equation 1, [Mn], [P], [Si], [Al], and [C] represent values obtained by dividing a content (wt %) of each element by an atomic weight of each element, and [oxide layer thickness] represents a thickness (nm) of oxide layer)

When the $I_{PEI}$ value is too low, the thickness of the oxide layer, which is advantageous for securing adhesion, is thin, and the amount of aluminum oxide formed increases, thereby lowering the adhesion between the enamel glaze layer and the base iron. On the other hand, when the $I_{PEI}$ value is too high, there is a problem in that the amount of gas generated on the surface of the steel sheet increases during enamel firing heat treatment, causing the bubble defects. Therefore, the adhesion relationship index ($I_{PEI}$) value was limited to 0.001 to 0.020. More specifically, the $I_{PEI}$ value may be 0.001 to 0.019.

In the enamel steel sheet according to an exemplary embodiment of the present invention, a cementite fraction difference (Cv) calculated by the following Equation 2 may be 0.8 to 2.5%.

$$CV=C_{1/2t}-C_{1/8t} \quad \text{[Equation 2]}$$

(In Equation 2, $C_{1/2t}$ and $C_{1/8t}$ represent the cementite fraction in a center and a ⅛ site in the thickness direction of the steel sheet, respectively.)

Carbon present in the metal alloy is combined with metal atoms to form carbides, and one of the carbides formed at a relatively low temperature by combining iron with carbon is cementite. Usually, in the carbon steel, the cementite is formed between 250 and 700° C., and is coarsened into spherical particles at a higher temperature than the above temperature. The cementite generated in the hot rolling process is crushed in the cold rolling process and decomposed in the decarburization process to act as a source for occluding hydrogen. However, when these cementites are intensively present on the surface of the steel, these cementites become a source that promotes the gasification reaction of carbon during the enamel firing, which becomes a factor inducing the bubble defects. Therefore, it is necessary to strictly control the carbide volume fraction in the thickness direction in order to suppress the fishscale and bubble defects of the enamel products. That is, when the cementite fraction difference Cv in the thickness direction of the cold-rolled steel sheet is too small, the carbide fraction in the surface layer increases as the decarburization reaction does not proceed smoothly, which acts as a factor inducing the bubble defects after the enamel firing. On the other hand, when Cv is too large, there is a problem in that it is difficult to suppress the occurrence of the fishscale defect because the supply of sites capable of occluding hydrogen in the cavity is insufficient. Therefore, the cementite fraction difference Cv in the thickness direction may be 0.8 to 2.5%. More preferably, Cv may be 0.85 to 2.45%.

According to an exemplary embodiment of the present invention, a micropore area ratio difference (MVv) for each site calculated by the following Equation 3 may be 0.07 to 0.16%.

$$MVv=MV_{1/8t}-MV_{Av} \quad \text{[Equation 3]}$$

(In Equation 3, $MV_{1/8t}$ and $MV_{Av}$ represent a ⅛ site and an average micropore fraction in a thickness direction, respectively.)

The cementite precipitated during the hot rolling is crushed during the cold rolling and the decarburization heat treatment to form micropores around them. The formed micropores act as the occlusion source of hydrogen to suppress the occurrence of the fishscale defect. For the micropore in the cold-rolled steel in cold-rolled steel sheet, after taking 10 photos with a magnification of 1000 times the surface parallel to the rolling surface (ND surface) using a scanning electron microscope, the area fraction of the micropores occupied by these areas was measured using an image analyzer. In an exemplary embodiment of the present invention, it was confirmed that there is a region capable of simultaneously suppressing the fishscale and bubble defects by controlling the distribution of the area ratio of these micropores for each site. In order to secure such an effect, it was necessary to manage the micropore area ratio difference MVv to 0.07 to 0.16%. When the micropore area ratio difference MVv is too small, it is advantageous in terms of the fishscale resistance, but the problems with the deterioration in the workability and the surface defects such as the bubble defects may occur frequently. On the other hand, when the MVv is too large, there are few sites that act as the hydrogen occlusion source that may fix hydrogen in the cavity, so there may be a problem in that the fishscale defect rate of the product increases. Therefore, the micropore area ratio difference MVv was limited to 0.070 to 0.160%. More specifically, the MVv may be 0.075 to 0.155%.

The enamel adhesion of the enamel steel sheet according to an exemplary embodiment of the present invention may be 95% or more. By satisfying these properties, it may be applied as a material for enamel even using a relatively inexpensive glaze. When the enamel adhesion is too low, since the glaze layer is dropped out during the distribution or handling after the enamel treatment and the marketability as the enamel material is lowered, in an enamel yarn, expensive glaze with a large amount of NiO is applied, which acts as a factor of increasing the cost. Therefore, efforts are being made to propose a method of securing enamel adhesion even with low-cost glaze. In general, when the enamel adhesion is 90% or more, it is classified as the best enamel product, but in an exemplary embodiment of the present invention, a method for securing enamel adhesion of 95% or more is proposed. In addition, when the enamel adhesion is lowered, the fishscale generation rate by hydrogen also increases in steel, so it is preferable to secure as high adhesion as possible. In the present invention, the excellent adhesion to enamel of 95% or more was secured in terms of the adhesion and the fishscale control. More specifically, the enamel adhesion may be 96% or more. The enamel adhesion refers to a numerical value expressed by indexing the drop out degree of the enamel glaze layer by evaluating the degree of energization at this site after a certain load is applied to the enamel layer with a steel ball as defined in the American Society for Testing and Materials standard, ASTM C313-78.

The enamel steel sheet according to an exemplary embodiment of the present invention may have a hydrogen permeation ratio of 600 seconds/$mm^2$ or more. The hydrogen permeability ratio is a representative index for evaluating fishscale resistance indicating resistance to the fishscale defect which is a fatal defect when applying the enamel steel manufactured using the cold-rolled steel sheet according to an exemplary embodiment of the present invention, and evaluates the ability to fix hydrogen in the steel plate by the method listed in European standard (EN10209). A value expressed by generating hydrogen from one direction of the steel sheet and measuring a time ($t_s$, unit: seconds) for hydrogen to permeate into the opposite side of the steel sheet and dividing this by a square of the material thickness (t, unit: mm) is expressed as $t_s/t^2$ (unit: second/$mm^2$). When the hydrogen permeation ratio is too low, in a case in which in the case where resistance to the fishscale defect is evaluated by the accelerated heat treatment at 200° C. for 24 hours after the enamel treatment, since there is a problem of using it as a stable enamel product because the defect rate is over 50%, in order to secure the steel sheet with the excellent fishscale resistance, it is necessary to manage the hydrogen permeation ratio at 600 sec/$mm^2$ or more. Also, more specifically, the hydrogen permeation ratio may be 610 sec/$mm^2$ or more.

The method of manufacturing an enamel steel sheet according to an embodiment of the present invention includes: manufacturing a hot-rolled steel sheet by hot rolling a slab containing, by wt %, 0.01 to 0.05% of C, 0.46 to 0.80% of Mn, 0.001 to 0.03% of Si, 0.01 to 0.08% of Al, 0.001 to 0.02% of P, 0.001 to 0.02% of S, 0.004% or less (excluding 0%) of N, 0.003% or less (excluding 0%) of O, and the balance of Fe and inevitable impurities, and the balance of Fe and inevitable impurities; manufacturing a cold-rolled steel sheet by cold rolling the hot-rolled steel sheet; and annealing the cold-rolled steel sheet.

First, the slab satisfying the above-described composition is prepared. The molten steel whose composition is adjusted to the above-described composition in the steelmaking process may be manufactured into a slab through continuous casting. As described above, in the process of annealing the cold-rolled steel sheet, the contents of C and O are partially changed, and other alloy components are substantially the same as the above-described enamel steel sheet. Since the alloy components have been described above, overlapping descriptions thereof will be omitted.

Thereafter, the manufactured slab is heated. By heating, the subsequent hot rolling process may be smoothly performed, and the slab may be homogenized. More specifically, the heating may mean reheating In this case, the slab heating temperature may be 1150 to 1280° C. When the slab heating temperature is too low, the rolling load may increase rapidly in the subsequent hot rolling process, which may lower workability. On the other hand, when the slab heating temperature is too high, not only the energy cost increases, but also the amount of surface scale increases, which may lead to material loss. More specifically, it may be 1180 to 1260° C.

Thereafter, the heated slab is hot-rolled to manufacture the hot-rolled steel sheet.

In this case, the finish rolling temperature of the hot rolling may be 850 to 910° C. When the finishing hot rolling temperature is too low, as the rolling is finished in the low temperature region, grain mixing proceeds rapidly, which may lead to the deterioration in rollability and workability. On the other hand, when the finishing hot rolling temperature is too high, the peelability of the surface scale is deteriorated, and the impact toughness due to grain growth may be lowered as the uniform hot rolling is not performed throughout the thickness. More specifically, the finishing hot rolling temperature may be 860 to 900° C.

Thereafter, the hot-rolled steel sheet manufactured after the hot rolling is finished is subjected to a winding process. More specifically, it may be a hot-rolled winding process.

In this case, the winding temperature may be 580 to 720° C. The hot-rolled steel sheet may be cooled in a run-out-table (ROT) before winding. When the hot rolling winding temperature is too low, the temperature non-uniformity in the width direction occurs in the cooling and maintaining process, which not only causes material deviation as the formation of low-temperature precipitates is changed, but also adversely affected the enamel properties. On the other hand, when the winding temperature is too high, as the agglomeration of the carbide progresses, there is problem in that the corrosion resistance is lowered, the P grain boundary segregation is promoted to lower the cold rollability, and the workability is lowered due to coarsening of the structure in the final product. More specifically, the winding temperature may be 590 to 710° C.

The wound hot-rolled steel sheet may further include a step of pickling the steel sheet before the cold rolling.

Thereafter, the wound hot-rolled steel sheet is manufactured into the cold-rolled steel sheet through the cold rolling.

In this case, the cold reduction ratio may be 60 to 90%. When the cold reduction ratio is too low, as the recrystallization driving force in the subsequent heat treatment process is not secured, non-recrystallized grains remain locally, which increases the strength, but significantly reduces the workability. In addition, as the crushing ability of the carbide formed in the hot-rolling process is lowered, the number of sites that may occlude hydrogen is reduced, making it difficult to secure the fishscale resistance, and considering the thickness of the final product, the thickness of the hot-rolled plate is lowered, so there was a problem that the rolling workability was also lowered. On the other hand, when the cold reduction ratio is too high, the material is hardened and the workability is deteriorated, as well as the load of the rolling mill increases, which deteriorates the operability. More specifically, the cold reduction ratio may be 63 to 88%.

Thereafter, the cold-rolled steel sheet is manufactured into the enamel steel sheet through the continuous annealing heat treatment. The cold-rolled material has high strength due to high deformation applied in the cold rolling, but has extremely poor workability, so the workability and decarburization reaction are secured by performing atmospheric heat treatment in the subsequent process.

In the process of heat-treating the cold-rolled steel sheet, in an exemplary embodiment of the present invention, the oxidation capacity ($PH_2O/PH_2$) condition is controlled so that the diffusion rate of carbon atoms is optimal to promote external diffusion of carbon atoms in the material, thereby improving decarburization properties. For this purpose, as a standard for optimization management of the decarburization annealing process, the decarburization temperature is in the range of 720 to 850° C., and the oxidation capacity ($PH_2O/PH_2$) is heat-treated in a wet atmosphere of 0.51 to 0.65. In this case, the appropriate holding time is 20 to 180 seconds.

In this case, the heat treatment temperature may be 720 to 850° C. When the decarburization annealing temperature is too low, as the deformation formed by the cold rolling is not sufficiently removed, the workability is significantly reduced, and the decarburization rate by the atmospheric heat treatment is too low, so the desired characteristics of the cold-rolled enamel steel sheet may not be secured. On the other hand, when the heat treatment temperature is too high, not only the annealing passing ability due to plate breakage due to softening caused by the deterioration in the high temperature strength is lowered, but also the decarburization reaction is suppressed by increasing the thickness of the surface oxide layer, so the heat treatment temperature may be limited to 720 to 840° C. More preferably, the annealing temperature may be 730 to 840° C.

In this case, the oxidation capacity ($PH_2O/PH_2$) of the heat treatment atmosphere may be 0.51 to 0.65. When the oxidation capacity is too low, it takes a long time for decarburization, and thus, the decarburization is lowered during the continuous annealing, so it may be difficult to secure the enamel properties. On the other hand, when the oxidation capacity is too high, there is a problem in that the occurrence rate of the surface defects due to the surface film formed by peroxidation is high. Therefore, the oxidation capacity of the atmospheric gas was limited to 0.51 to 0.65. More specifically, the oxidation capacity may be 0.52 to 0.64.

In addition, the crack holding time in the atmospheric continuous annealing process may be 20 to 180 seconds. Even when the cracking time at the holding temperature is too short, unrecrystallized grains remain, which greatly deteriorates the formability, and the decarburization reaction in the thickness direction does not work smoothly, which acts as a factor that lowers the enamel property, whereas when the holding time is too long, abnormal grain growth occurs due to the decarburization reaction, and thus, there is a problem of deterioration in workability due to material non-uniformity and deterioration in fishscale properties.

Accordingly, the holding time at the cracking temperature may be 20 to 180 seconds. More preferably, the holding time may be 25 seconds to 160 seconds.

In addition, the process of temper rolling the heat-treated steel sheet after annealing the cold-rolled steel sheet may be further included. Through the temper rolling, the shape of the material may be controlled and the desired surface roughness may be obtained, but when the temper reduction ratio is too high, since there is a problem in that the material is hardened by work hardening and the workability is lowered, the reduction ratio of the temper rolling may be 3% or less. Specifically, the reduction ratio of the temper rolling may be 0.3 to 2.5%.

Hereinafter, the present invention will be described in more detail with reference to examples. However, it is necessary to note that the following examples are only for illustrating the present invention in more detail and are not intended to limit the scope of the present invention. This is because the scope of the present invention is determined by the matters described in the claims and matters reasonably inferred therefrom

EXAMPLES

A slab was prepared through a converter-second refining-casting process with, by wt %, the composition of Table 1 below and an alloy component including the remainder iron (Fe) and unavoidable impurities. This slab was maintained in a heating furnace at 1200° C. for 1 hour, and then subjected to hot rolling. In this case, the final thickness of the hot-rolled steel sheet was 4.0 mm. The hot-rolled specimen was subjected to cold rolling with a reduction ratio after removing an oxide film on a surface through pickling treatment. The specimens subjected to the cold rolling were processed into enamel-treated specimens to investigate enamel properties and specimens for mechanical property analysis, and were subjected to heat treatment. Finishing hot rolling temperature, winding temperature, a cold reduction ratio, annealing temperature, holding time, and oxidation capacity are summarized in Table 2 below.

Table 3 below shows operability, enamel property, tissue properties, and the like of materials obtained through the above process for each manufacturing condition.

In the case of passing ability, "0" indicates operability of 90% or more compared to productivity of normal materials in the casting, hot rolling, and cold rolling processes, and "X" indicates that productivity is 90% or less or the defect occurrence rate is 10% or more.

The carbide fraction was obtained as the carbide fraction for the entire viewing area using an image analyzer after securing an image of 20 fields of view at 500 times magnification with an optical microscope.

The specimen of enamel treatment was cut to an appropriate size for each application to meet the purpose of the test. After the specimen for enamel treatment that is heat treated was completely degreased, the specimen was applied with a standard glaze (check frit) which is relatively vulnerable to the fishscale defects, and maintained at 300° C. for 10 minutes to remove moisture. The dried specimen was fired at a relatively low 800° C. for 20 minutes in order to highlight the differences in enamel properties such as adhesion, and then cooled to room temperature. In this case, an atmospheric condition of a kiln was a dew point temperature of 30° C., which is a harsh condition where fishscale defects are easy to occur. After the specimen is subjected to the enamel treatment, a fishscale acceleration test was performed in which the specimen was maintained in an oven at 200° C. for 24 hours.

After the fishscale acceleration treatment, the presence or absence of the fishscale defect was visually observed, and the case in which the fishscale defect does not occur was denoted by "O" and the case in which fishscale defect occurs was denoted by "X".

The enamel adhesion, which evaluated the adhesion between the steel plate and the glaze was indicated by indexing the drop out degree of the enamel glaze layer by evaluating the degree of energization at this site after a certain load is applied to the enamel layer with a steel ball as defined in the American Society for Testing and Materials standard, ASTM C313-78. In the present invention, in the case of the enamel adhesion, the goal was to secure more than 95% in terms of securing application stability in relatively inexpensive glazes.

The enamel surface was visually observed on the specimens maintained in an oven at 200° C. for 24 hours after the enamel treatment, and thus, the bubble defects were determined to be "0" excellent, "A" normal, and "X" bad, respectively.

The hydrogen permeation ratio is one of the indices for evaluating the resistance to the fishscale, which is a fatal defect of the enamel, and is represented by $t_s/t^2$ (unit, sec/mm$^2$) which is a value obtained by measuring a time ($t_s$, unit second) that hydrogen is generated in one direction of a steel sheet and the hydrogen permeates into an opposite side by an experimental method indicated in the European standard (EN10209-2013), and dividing the time by a square of a material thickness (t, unit mm).

TABLE 1

| Division | C | Mn | Si | Al | P | S | N | O | Others |
|---|---|---|---|---|---|---|---|---|---|
| Inventive Steel 1 | 0.028 | 0.49 | 0.015 | 0.036 | 0.012 | 0.015 | 0.0021 | 0.0015 | — |
| Inventive Steel 2 | 0.046 | 0.57 | 0.009 | 0.044 | 0.011 | 0.012 | 0.0027 | 0.0009 | — |
| Inventive Steel 3 | 0.035 | 0.61 | 0.018 | 0.025 | 0.009 | 0.009 | 0.0018 | 0.0011 | — |
| Inventive Steel 4 | 0.051 | 0.52 | 0.022 | 0.039 | 0.006 | 0.011 | 0.0014 | 0.0019 | — |
| Inventive Steel 5 | 0.072 | 0.68 | 0.007 | 0.041 | 0.013 | 0.006 | 0.0025 | 0.0007 | — |
| Comparative Steel 1 | 0.004 | 0.15 | 0.011 | 0.058 | 0.006 | 0.052 | 0.0048 | 0.0018 | Ti: 0.105 |
| Comparative Steel 2 | 0.002 | 0.51 | 0.009 | 0.001 | 0.012 | 0.008 | 0.0021 | 0.0458 | — |
| Comparative Steel 3 | 0.017 | 0.28 | 0.021 | 0.042 | 0.011 | 0.011 | 0.0015 | 0.0015 | — |

TABLE 1-continued

| Division | C | Mn | Si | Al | P | S | N | O | Others |
|---|---|---|---|---|---|---|---|---|---|
| Comparative Steel 4 | 0.094 | 0.96 | 0.005 | 0.039 | 0.014 | 0.004 | 0.0028 | 0.0418 | — |
| Comparative Steel 5 | 0.056 | 0.46 | 0.251 | 0.001 | 0.009 | 0.035 | 0.0118 | 0.0012 | Ti: 0.056 |

TABLE 2

| Division | Steel type No. | Finishing hot rolling temperature (° C.) | Winding temperature (° C.) | Cold rolling reduction ratio (%) | Annealing temperature (° C.) | Holding time (sec) | Oxidation capacity ($P_{H2O}/P_{H2}$) | Oxidation layer thickness (μm) | C after decarburization (wt %) | $I_{PEI}$ value |
|---|---|---|---|---|---|---|---|---|---|---|
| Inventive Example 1 | Inventive Steel 1 | 880 | 640 | 80 | 760 | 125 | 0.53 | 0.024 | 0.016 | 0.0166 |
| Inventive Example 2 | Inventive Steel 1 | 880 | 640 | 80 | 790 | 90 | 0.53 | 0.018 | 0.015 | 0.0125 |
| Inventive Example 3 | Inventive Steel 1 | 880 | 640 | 80 | 820 | 40 | 0.53 | 0.009 | 0.010 | 0.0062 |
| Inventive Example 4 | Inventive Steel 2 | 890 | 680 | 70 | 780 | 69 | 0.62 | 0.015 | 0.025 | 0.0033 |
| Inventive Example 5 | Inventive Steel 2 | 890 | 680 | 85 | 830 | 35 | 0.62 | 0.022 | 0.023 | 0.0049 |
| Inventive Example 6 | Inventive Steel 3 | 890 | 700 | 75 | 810 | 72 | 0.55 | 0.012 | 0.021 | 0.0107 |
| Inventive Example 7 | Inventive Steel 4 | 890 | 700 | 80 | 820 | 90 | 0.55 | 0.021 | 0.032 | 0.0057 |
| Inventive Example 8 | Inventive Steel 5 | 890 | 620 | 75 | 780 | 142 | 0.60 | 0.008 | 0.041 | 0.0013 |
| Inventive Example 9 | Inventive Steel 5 | 890 | 620 | 75 | 820 | 84 | 0.60 | 0.015 | 0.037 | 0.0025 |
| Comparative Example1 | Inventive Steel 1 | 750 | 640 | 80 | 620 | 90 | 0.21 | 0.003 | 0.025 | 0.0021 |
| Comparative Example2 | Inventive Steel 2 | 890 | 680 | 50 | 830 | 20 | 0.62 | 0.005 | 0.040 | 0.0011 |
| Comparative Example3 | Inventive Steel 3 | 890 | 540 | 92 | 810 | 40 | 0.79 | 0.003 | 0.011 | 0.0027 |
| Comparative Example4 | Inventive Steel 4 | 890 | 760 | 80 | 880 | 200 | 0.55 | 0.042 | 0.015 | 0.0115 |
| Comparative Example5 | Comparative Steel 1 | 920 | 680 | 80 | 830 | 90 | 0.21 | 0.002 | 0.002 | 0.0007 |
| Comparative Example6 | Comparative Steel 2 | 910 | 680 | 80 | 800 | 90 | 0.52 | 0.062 | 0.002 | 13.519 |
| Comparative Example7 | Comparative Steel 3 | 880 | 680 | 75 | 800 | 60 | 0.55 | 0.001 | 0.006 | 0.0007 |
| Comparative Example8 | Comparative Steel 4 | 880 | 680 | 75 | 800 | 60 | 0.55 | 0.003 | 0.063 | 0.0004 |
| Comparative Example9 | Comparative Steel 5 | 880 | 680 | 75 | 800 | 60 | 0.55 | 0.002 | 0.052 | 0.2938 |

TABLE 3

| Division | Passing ability | $C_v$ value (%) | $MV_v$ value (%) | Bubble defect Presence or absence of occurrence | Fishscale Presence or absence of occurrence | Enamel adhesion (%) | Hydrogen permeation ratio (sec/mm$^2$) |
|---|---|---|---|---|---|---|---|
| Inventive Example 1 | ○ | 0.98 | 0.081 | ○ | ○ | 98.5 | 689 |
| Inventive Example 2 | ○ | 1.14 | 0.094 | ○ | ○ | 99.1 | 724 |
| Inventive Example 3 | ○ | 1.82 | 0.096 | ○ | ○ | 100 | 790 |
| Inventive Example 4 | ○ | 1.75 | 0.103 | ○ | ○ | 99.7 | 835 |
| Inventive Example 5 | ○ | 2.13 | 0.121 | ○ | ○ | 99.5 | 862 |
| Inventive Example 6 | ○ | 1.86 | 0.109 | ○ | ○ | 100 | 1023 |
| Inventive Example 7 | ○ | 2.32 | 0.135 | ○ | ○ | 98.8 | 954 |
| Inventive Example 8 | ○ | 1.92 | 0.132 | ○ | ○ | 99.7 | 1137 |
| Inventive Example 9 | ○ | 2.38 | 0.115 | ○ | ○ | 100 | 1068 |
| Comparative Example1 | X | 0.35 | 0.041 | X | X | 86.8 | 482 |
| Comparative Example2 | ○ | 0.62 | 0.064 | X | X | 90.4 | 569 |
| Comparative Example3 | X | 2.94 | 0.18 | Δ | X | 93.4 | 494 |
| Comparative Example4 | X | 3.11 | 0.042 | X | X | 84.2 | 572 |
| Comparative Example5 | X | 0.01 | 0.002 | ○ | X | 82.9 | 488 |
| Comparative Example6 | X | 0.01 | 0.003 | ○ | X | 89.2 | 385 |
| Comparative Example7 | ○ | 0.52 | 0.031 | X | X | 80.2 | 206 |
| Comparative Example8 | X | 4.12 | 0.052 | X | X | 79.6 | 439 |
| Comparative Example9 | X | 0.26 | 0.047 | X | X | 75.4 | 502 |

As can be seen in Tables 1 to 3, Inventive Examples 1 to 9, which satisfy all of the component compositions, manufacturing conditions, and oxide layer thickness of the present invention not only had good passing ability, but also satisfied the limited range of the present invention in terms of carbide and micropore fractions and related indices, and did not have enamel defects such as fishscale and bubble defects even under severe treatment conditions, and satisfied enamel adhesion of 95% or more, a hydrogen permeability ratio of 600 sec/mm$^2$ or more, and an adhesion related index $I_{PEI}$ value of 0.001 to 0.001 to By satisfying 0.020, thereby securing the properties targeted by the present invention.

On the other hand, Comparative Examples 1 to 4, which satisfied the chemical compositions presented in the present invention but are cases where the oxidation capacity and time range during the final annealing were not satisfied, did not properly form an oxide layer, so it can be seen that the target properties could not be secured. As shown in Table 3, it can be seen that, as the distribution of micropores deviates from the management standards, the hydrogen permeation ratio is lower than the target (Comparative Examples 1 to 4), the enamel adhesion is less than 95% (Comparative Examples 1 to 4), or after the enamel treatment, the enamel defects such as the bubble defect or the fishscale occur, so it was not possible to secure the targeted properties as a whole.

Comparative Examples 5 to 9 are cases where the manufacturing conditions presented in the present invention are satisfied but the alloy composition is not satisfied. Comparative Examples 5 to 9 not only did not satisfy the management standards of cementite and micropore area fraction, surface oxide layer thickness, adhesion index, hydrogen permeability ratio, enamel adhesion, etc. of the present invention for each thickness direction, but also caused the fishscale or bubble defects even when visually observed after enamel treatment, and thus, had a problem in applicability.

Figure 2:
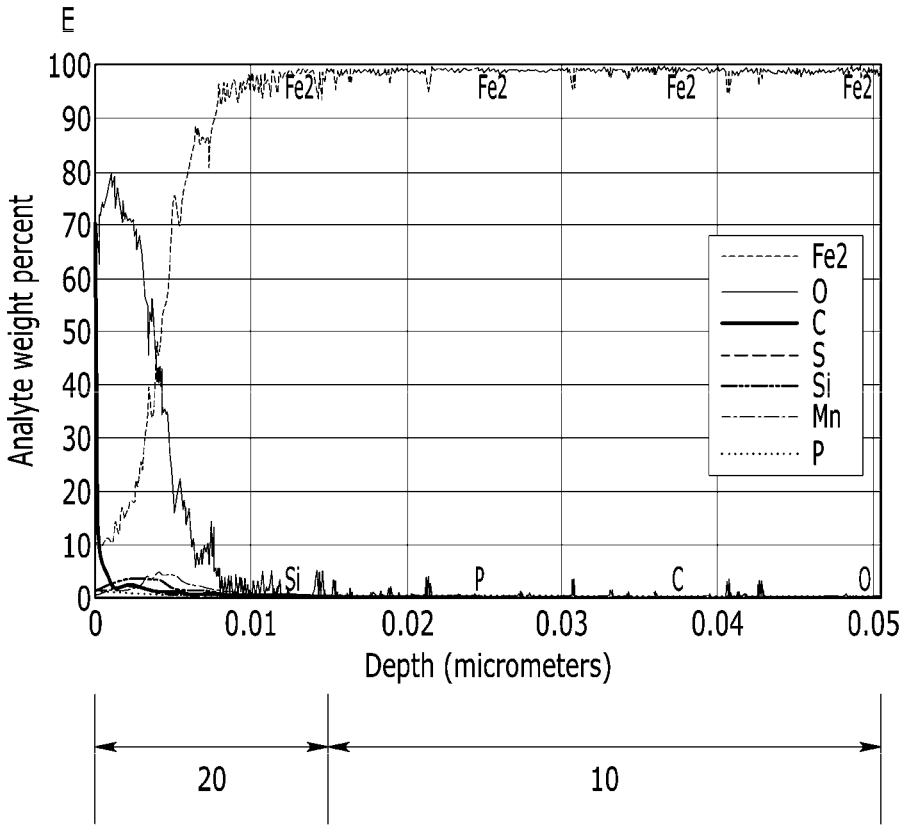
FIG. 2 is a GDS analysis result for each depth of an enamel steel sheet according to Inventive Example 4.

FIG. 2 illustrates a GDS analysis result for each depth of an enamel steel sheet according to Inventive Example 4. It can be seen that the innermost point where the oxygen content is 5 wt % is 0.015 μm, and the oxide layer 20 having a thickness of 0.015 μm is present on the surface.

The present invention is not limited to the exemplary embodiments, but may be manufactured in a variety of different forms, and the present invention may be manufactured in a variety of different forms, and those of ordinary skill in the art to which the present invention pertains will understand that the present invention may be implemented in other specific forms without changing the technical spirit or essential features of the present invention. Therefore, it should be understood that the above-mentioned exemplary embodiments are exemplary in all aspects but are not limited thereto.

| Reference Signs List | | | |
|---|---|---|---|
| 100: | Enamel steel sheet | 10: | Steel sheet substrate |
| 20: | Oxide layer | | |

The invention claimed is:

1. An enamel steel sheet, comprising:

by wt %, 0.01 to 0.05% of C, 0.46 to 0.80% of Mn, 0.001 to 0.03% of Si, 0.01 to 0.08% of Al, 0.001 to 0.02% of P, 0.001 to 0.02% of S, 0.004% or less (excluding 0%) of N, 0.003% or less (excluding 0%) of O, and the balance of Fe and inevitable impurities, and an oxide layer on a surface of the steel sheet, the oxide layer having a thickness of 0.006 to 0.030 μm.

2. The enamel steel sheet of claim 1, wherein:

the oxide layer contains 90 wt % or more of Fe oxide.

3. The enamel steel sheet of claim 1, wherein:

an adhesion relationship index (IPEI) calculated by the following Equation 1 is 0.001 to 0.020, $$IPEI=(Mn\times P\times Si\times \text{oxide layer thickness})/(Al\times C) \quad \text{Equation 1:}$$

wherein in Equation 1, Mn, P, Si, Al, and C represent values obtained by dividing a content (wt %) of each element by an atomic weight of each element, and oxide layer thickness represents a thickness (nm) of oxide layer.

4. The enamel steel sheet of claim 1, wherein:

a micropore area ratio difference (MVv) for each site calculated by the following Equation 3 is 0.07 to 0.16%, $$MVv=MV_{1/8t}-MV_{Av} \quad \text{Equation 3:}$$

wherein in Equation 3, $MV_{1/8t}$ and $MV_{Av}$ represent a ⅛ site and an average micropore fraction in a thickness direction, respectively.

5. The enamel steel sheet of claim 1, wherein the enamel sheet further comprises:

at least one of 0.01 wt % or less of Cu and 0.005 wt % or less of Ti.

6. The enamel steel sheet of claim 1, wherein:

a cementite fraction difference (Cv) calculated by the following Equation 2 is 0.8 to 2.5%, $$Cv=C_{1/2t}-C_{1/8t} \quad \text{Equation 2:}$$

wherein in Equation 2, $C_{1/2t}$ and $C_{1/8t}$ represent the cementite fraction in a center and a ⅛ site in the thickness direction of the steel sheet, respectively.

7. The enamel steel sheet of claim 1, wherein:

enamel adhesion is 95% or more.

8. The enamel steel sheet of claim 1, wherein:

a hydrogen permeation ratio is 600 sec/mm2 or more.

9. A method of manufacturing the enamel steel sheet of claim 1, comprising:

manufacturing a hot-rolled steel sheet by hot rolling a slab containing, by wt %, 0.01 to 0.05% of C, 0.46 to 0.80% of Mn, 0.001 to 0.03% of Si, 0.01 to 0.08% of Al, 0.001 to 0.02% of P, 0.001 to 0.02% of S, 0.004% or less (excluding 0%) of N, 0.003% or less (excluding 0%) of O, and the balance of Fe and inevitable impurities, and the balance of Fe and inevitable impurities;

manufacturing a cold-rolled steel sheet by cold rolling the hot-rolled steel sheet; and annealing the cold-rolled steel sheet, wherein, in the annealing, heat treatment is performed for 30 seconds to 180 seconds in a wet atmosphere having an oxidation capacity index ($PH_2O/PH_2$) of 0.51 to 0.65.

10. The method of claim 9, wherein:

the slab is hot-rolled at a finish rolling temperature of 850° C. to 910° C.

11. The method of claim 9, wherein:

in the manufacturing of the hot-rolled steel sheet, the hot-rolled steel sheet is wound at 580° C. to 720° C.

12. The method of claim 9, wherein:

in the manufacturing of the cold-rolled steel sheet, the cold rolling is performed at a reduction ratio of 60 to 90%.

13. The method of claim 9, wherein:

in the annealing of the cold-rolled steel sheet, the annealing is performed at 720° C. to 850° C.

14. The method of claim 9, further comprising:

after the annealing of the cold-rolled steel sheet, temper rolling at a reduction ratio of 3% or less.

* * * * *